US008764117B2

(12) United States Patent
van Hekken et al.

(10) Patent No.: US 8,764,117 B2
(45) Date of Patent: Jul. 1, 2014

(54) METHOD OF FABRICATING A CHAIR

(71) Applicant: Knoll, Inc., East Greenville, PA (US)

(72) Inventors: Hendrik R. van Hekken, Allentown, PA (US); Jason Ferguson, Hatfield, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 13/874,583

(22) Filed: May 1, 2013

(65) Prior Publication Data

US 2013/0241260 A1 Sep. 19, 2013

Related U.S. Application Data

(63) Continuation of application No. 12/914,384, filed on Oct. 28, 2010, now Pat. No. 8,505,186.

(60) Provisional application No. 61/257,502, filed on Nov. 3, 2009.

(51) Int. Cl.
*A47C 31/00* (2006.01)

(52) U.S. Cl.
USPC ..... 297/463.1; 297/463.2; 29/525.05

(58) Field of Classification Search
USPC ..... 297/452.18, 463.1, 463.2; 411/447, 411/458; 29/525.01–525.05
See application file for complete search history.

(56) References Cited

U.S. PATENT DOCUMENTS 2,965,161 A 12/1960 Knoll
3,366,991 A 2/1968 Vasseur
3,371,956 A 3/1968 Jordan et al.
3,556,592 A 1/1971 Antoine
3,722,565 A 3/1973 Miller, Jr. et al.
4,261,667 A 4/1981 Ervin et al.
4,946,224 A 8/1990 Leib
5,011,227 A 4/1991 Ogino et al.
5,037,158 A 8/1991 Crawford
5,297,851 A 3/1994 Van Hekken
5,431,479 A 7/1995 Leib
5,464,274 A 11/1995 Golynsky et al.
5,499,413 A 3/1996 Van Hekken
5,791,733 A 8/1998 Van Hekken et al.
5,951,110 A 9/1999 Conner et al.
6,019,429 A 2/2000 Tedesco
6,033,028 A * 3/2000 Lovdahl ..... 297/463.1
6,053,578 A 4/2000 Van Hekken et al.
6,168,239 B1 1/2001 Conner et al.
6,349,992 B1 2/2002 Knoblock et al.
6,357,827 B1 3/2002 Brightbill et al.
6,394,553 B1 5/2002 McAllister et al.
(Continued)

*Primary Examiner* — Philip Gabler
(74) *Attorney, Agent, or Firm* — Buchanan Ingersoll & Rooney PC

(57) ABSTRACT

A method of making a chair includes the steps of providing at least one female fastener device. The at least one female fastener device is inserted into a substrate for attaching the at least one female fastener device to the substrate such that at least a portion of that female fastener device's body defining a channel extends into the substrate and the projections extend through the substrate such that the distal ends of the projections extend beyond a second side of the substrate that is opposite a first side of the substrate. The distal ends of the projections are bent into the second side of the substrate. At least one male fastener is inserted into the channel of the at least one female fastener device to attach a chair component to the substrate.

20 Claims, 9 Drawing Sheets

(56) References Cited

U.S. PATENT DOCUMENTS

| | | | | |
|---|---|---|---|---|
| 6,688,692 | B2 | 2/2004 | Phillips et al. | |
| 6,733,080 | B2 | 5/2004 | Stumpf et al. | |
| 6,817,667 | B2 | 11/2004 | Pennington et al. | |
| 6,824,218 | B1 | 11/2004 | Van Hekken | |
| 6,955,402 | B2 | 10/2005 | VanDeRiet et al. | |
| 7,165,811 | B2 | 1/2007 | Bodnar et al. | |
| 8,322,794 | B2 * | 12/2012 | Brown et al. | 297/463.2 |
| 8,505,186 | B2 * | 8/2013 | van Hekken et al. | 29/513 |
| 2006/0006715 | A1 | 1/2006 | Chadwick et al. | |

* cited by examiner

METHOD OF FABRICATING A CHAIR

CROSS REFERENCE TO RELATED APPLICATIONS

The present application is a continuation application of U.S. patent application Ser. No. 12/914,384, which claims priority to U.S. Provisional Patent Application No. 61/257,502, which was filed on Nov. 3, 2009. The entirety of U.S. Provisional Patent Application No. 61/257,502 is incorporated herein by reference.

FIELD OF THE INVENTION

The present invention relates to chairs and methods of making chairs.

BACKGROUND OF THE INVENTION

Chairs often include a seat or back. The seat or back can include a back frame or seat frame and a skin that covers the back frame or seat frame. The skins, particularly seat skins, can include a covering that covers foam attached to a liner or substrate affixed to a frame component. The foam of the skin may be welded or adhered or insert molded to the liner or substrate. The substrate or liner may then be attached to a frame component for attaching the seat skin to the frame. Screws, bolts, or other fasteners are often used to attach a frame component to a seat skin or back skin liner or substrate. U.S. Pat. Nos. 2,965,161, 3,366,991, 3,371,956, 3,556,592, 3,722,565, 4,261,667, 4,946,224, 5,011,227, 5,037,158, 5,297,851, 5,431,479, 5,464,274, 5,499,413, 5,791,733, 5,951,110, 6,019,429, 6,053,578, 6,168,239, 6,394,553, 6,349,992, 6,357,827, 6,688,692, 6,733,080, 6,817,667, 6,824,218, 6,955,402 and 7,165,811 and U.S. Patent Application Publication No. 2006/0006715 disclose examples of fasteners or fastening mechanisms used for attaching chair components together.

In some cases, it may be desirable to use a T-nut to receive fasteners used to connect a skin component to a frame component. For example, T-nuts may be used to attach wooden chair components together as disclosed in U.S. Pat. No. 3,722,565. However, the use of T-nuts often creates problems when used in conjunction with manufacturing chair components that are relatively thin, such as seat skins or back skins.

T-nuts include a body that defines an opening for receiving a fastener, such as a bolt or screw, for attaching a skin or liner to a frame. A T-nut may also include barbs that project from the body of the T-nut. The barbs are configured to attach the T-nut to a structure. For the barbs to effectively attach to the structure, the structure must have a certain thickness. The thickness of the structure can be a major limiting factor that requires increased costs for chair fabrication and can also minimize design options for certain chair structures or chair components.

If the thickness of the structure to which the T-nut or other fastener device is attached is not sufficient, then the T-nut can become displaced, loosened or separated from the structure when a fastener is inserted into the opening of the T-nut. For example, a screw that is passed through a hole in a frame component and into a threaded opening of a T-nut for attaching a skin component to a chair frame component to assemble a seat may be screwed into the opening of the T-nut. The force exerted by the screwing of the screw in the opening can cause the T-nut to rotate and become dislodged from the structure if the barbs of the T-nut are not attached to a sufficiently thick structure. Such dislodgments can prevent chair fabrication of certain chair designs.

Of course, such dislodgments may only occur intermittently during fabrication as a result of changes in structure dimensions due to tolerance control problems or may only act to loosen the T-nut from a structure. If such dislodgments go undetected during chair manufacturing, the dislodgments can create a problem for a chair purchaser. For instance, such a chair may require maintenance shortly after being purchased. Such problems can reduce the goodwill of the chair provider and can detract from the desirability of the chair.

A new method of assembling a chair is needed that can permit use of standard fastening devices such as T-nuts while also reducing manufacturing problems and providing broader design options.

SUMMARY OF THE INVENTION

A method of fabricating a chair is provided. The method includes the steps of providing a substrate and providing at least one female fastener device. The substrate may have a first side and a second side opposite the first side. The at least one female fastener device may include a body and a plurality of projections attached to the body. A portion of the body may define a channel that is sized and configured to receive a male fastener device. Each projection includes a distal end. The one or more female devices may be inserted into the substrate for attaching the at least one female fastener device to the substrate such that at least a portion of the body defining the channel extends from the first side of the substrate into the substrate and the projections extend through the substrate such that a portion of each of the projections extend into the first side of the substrate and the distal ends of the projections extend beyond the second side of the substrate. The distal ends of the projections are bent into the second side of the substrate. One or more male fasteners are inserted into the channel of the at least one female fastener to attach a chair component to the substrate. Each of the at least one male fastener is inserted into the channel of a respective one of the at least one female fastener.

Embodiments of the method may also include interconnecting other components of the chair to assemble the chair.

Preferably, the substrate is sized and configured to directly support a back skin, a seat skin, a seat covering, or a back covering. Alternatively, the substrate may support such a skin or covering, but may directly support foam or other cushioning that may be covered by the skin or covering.

The chair component may be a frame component. Preferably, the frame component is a component of the back frame or a component of the seat frame. For example, the component may be a seat pan, tilt control housing, or seat support structure. As another example, the component may be a chair back or a back plate of a chair back. The component could also be a shell that defines both a seat and back of the chair.

The substrate may be comprised of a polymeric material. The one or more female fastener devices may be comprised of metal, such as steel or stainless steel. Preferably, the at least one female fastener device is at least one T-nut that is composed of metal. The T-nut may be any T-nut that meets a design requirement, such as standard T-nut sizes that may be available from any number of suppliers. The at least one male fastener device may be at least one screw, at least one bolt, a combination of bolts and screws, or another type of male fastening device.

The bending of the distal ends of the projections may be accomplished in any of a number of ways. For example, the distal ends may be smashed into the second side of the substrate. Such smashing may plastically deform the distal ends of the projections. For instance, a mechanical tool may be utilized to smash the distal ends of the projections.

The first side of the substrate may be a top side of the substrate or a front side of the substrate. The second side of the substrate may be a bottom side of the substrate or a rear side of the substrate. Of course, the first and second sides could alternatively be switched such that the first side is a bottom or rear side and the second side is a top or front side.

At least a portion of the substrate may be covered by a covering, such as a seat skin or back skin. The back skin or front skin may include a fabric or leather covering and foam or other cushioning. The back skin or front skin may alternatively be composed of a relatively soft polymeric material. It should be understood that some embodiments of the back skin and some embodiments of the seat skin may not include foam or cushioning.

Each of the one or more female fastener devices may include a body that has a first end and a second end. The channel defined by the body or a portion of the body may extend from the first end to the second end. The first and second ends may each define an opening that communicates with the channel.

The substrate may include one or more holes formed therein. In some embodiments, the holes may be formed when the substrate is molded or may be punched or otherwise formed after the substrate is molded. Each hole is preferably sized to receive a portion of the body that defines the channel so that at least a portion of the channel extends into the substrate. Preferably, an end of the channel will be located adjacent to the first side of the substrate and the other end of the channel will be adjacent to the opposite side of the substrate.

A method of assembling components of an article of furniture is also provided. The method includes providing a substrate and at least one female fastener device. The one or more fastener devices include a base portion, a plurality of projections attached to the base portion, and a body portion attached to the base portion. The body portion extends away from the base portion and has a channel sized and configured to receive a male fastener device. Each projection extends away from the base portion and has a distal end. The one or more female fastener devices are inserted into the substrate for attaching the one or more female fastener devices to the substrate such that the base portion is adjacent to the first side of the substrate, at least a portion of the body extends into the substrate, and the projections extend through the substrate such that the distal ends of the projections extends beyond the second side of the substrate. The distal ends are bent into the second side of the substrate. One or more male fasteners are inserted into the channel of the one or more female fastener devices to attach a frame component to the substrate. Each of the at least one male fastener is inserted into the channel of a respective one of the at least one female fastener device.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of chairs and components of chairs and methods of making the same are provided in which.

DETAILED DESCRIPTION OF PRESENT PREFERRED EMBODIMENTS

Figure 1:
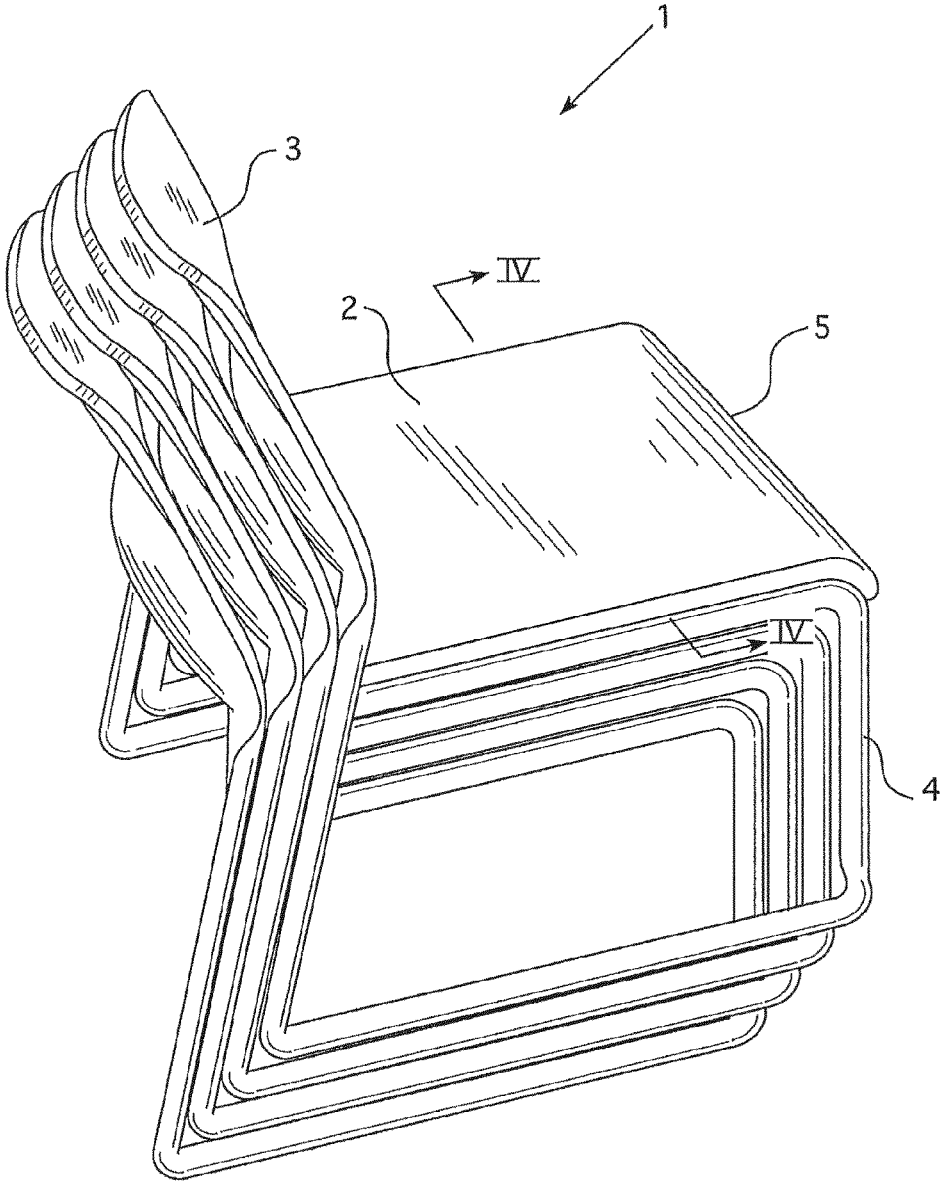
FIG. 1 is a perspective view of a first present preferred embodiment of a chair and a stack of chairs.
Figure 2:
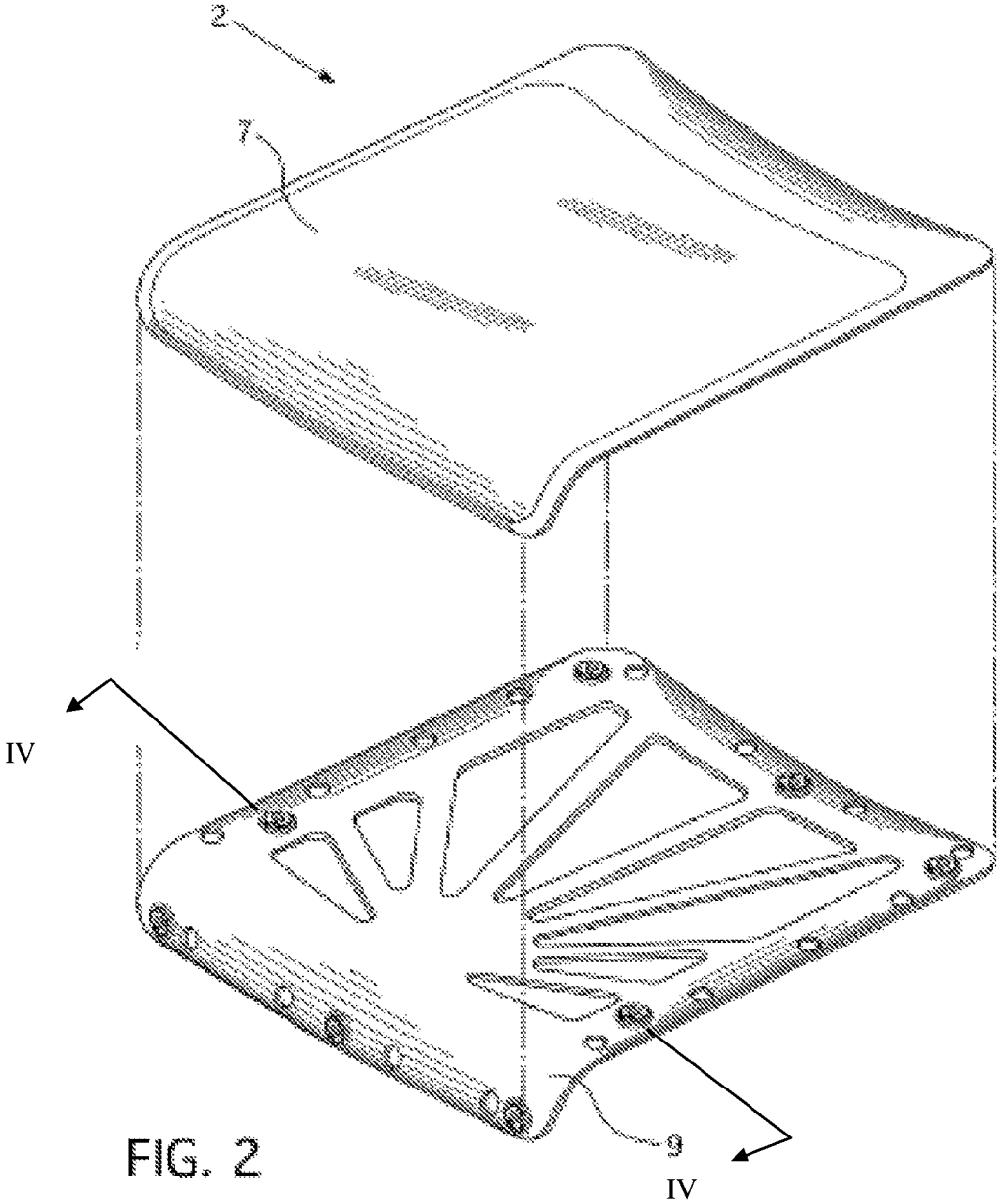
FIG. 2 is an exploded view of a present preferred seat component of the first present preferred embodiment of the chair.
Figure 3:
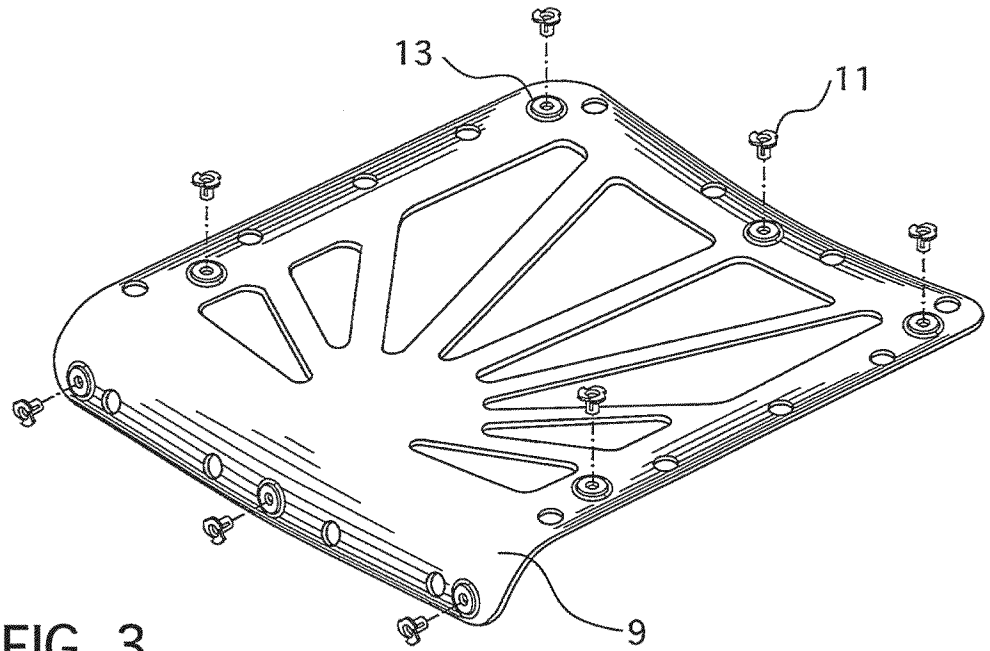
FIG. 3 is an exploded view of a present preferred substrate of the seat component shown in FIG. 2 that has holes sized to receive present preferred T-nuts that are affixed to the substrate for use in attaching the substrate to a frame component.
Figure 4:
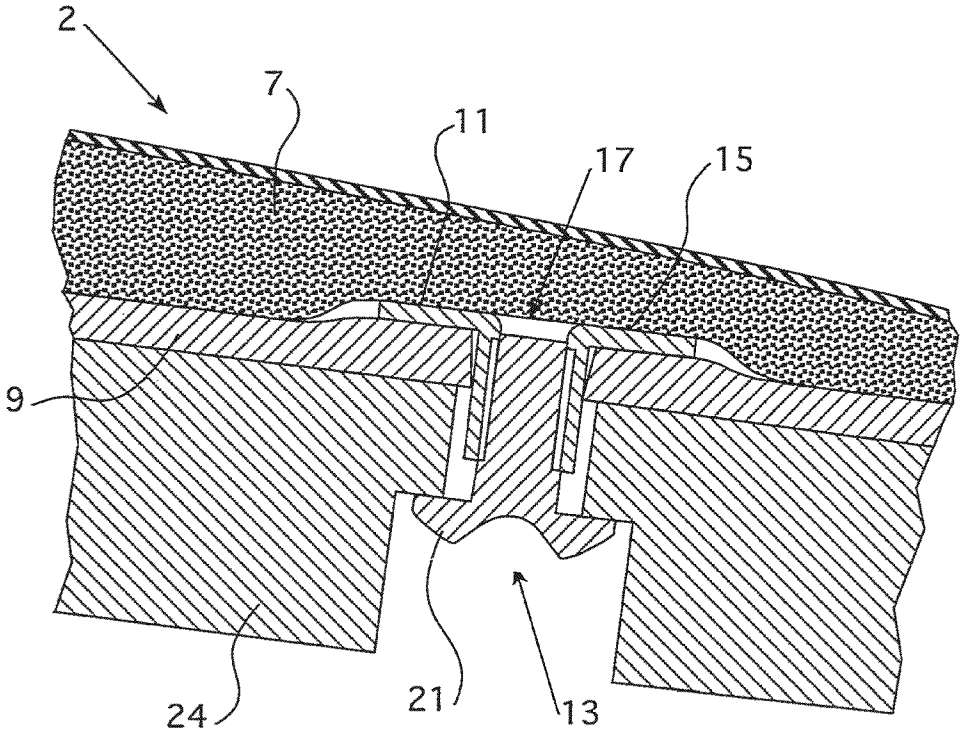
FIG. 4 is a cross sectional view taken along line IV-IV in FIGS. 1 and 2 that illustrates T-nut and fastener components of the first present preferred embodiment that are used to attach the seat component to a chair frame component.
Figure 5:
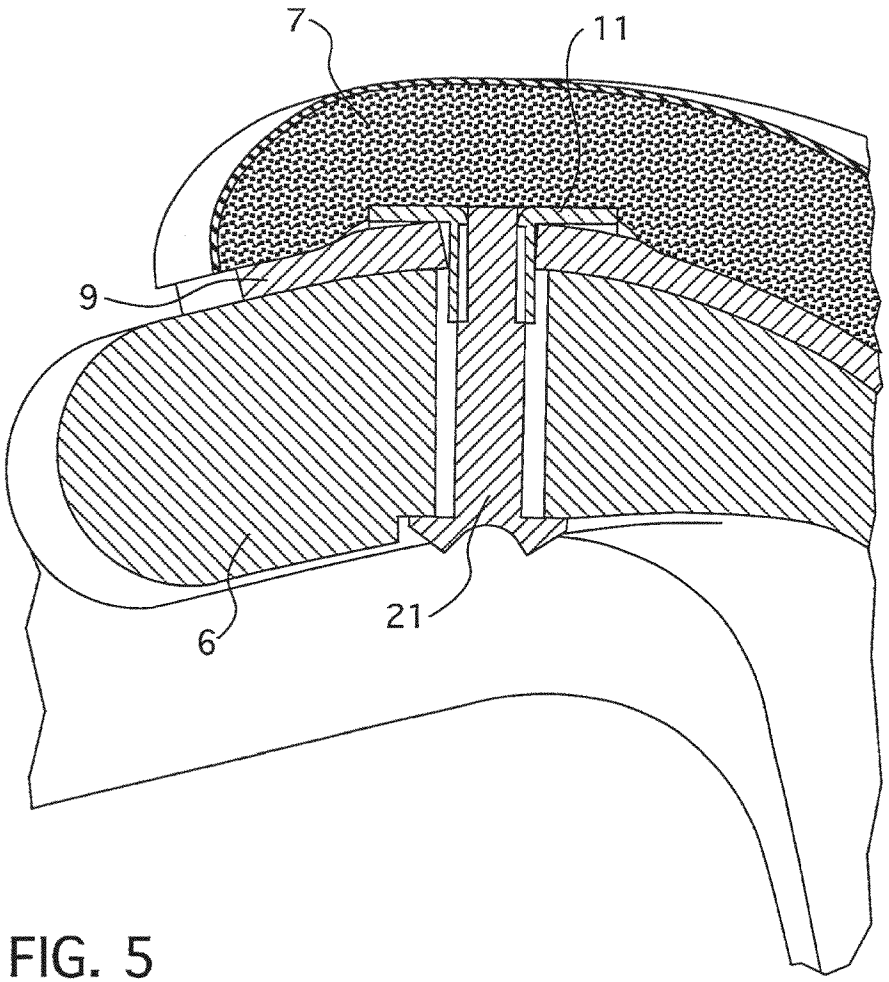
FIG. 5 is a cross sectional view similar to FIG. 4.

Referring to FIG. 1, a chair 1 may include a seat 2 and a back 3. The seat and back components may be attached to a base 4. The chair may be designed to be stackable onto other chairs to form a stack 5 of chairs.

Referring to FIGS. 2-5, a seat 2 may include a covering 7 that includes a foam cushion that is attached to a substrate 9. Preferably, the substrate 9 is a relatively thin liner composed of plastic and is between 0.08 inches and 0.187 inches thick. The substrate may have a circular or curved shape or have a polygonal shape. The substrate may also be a structure that is molded of a polymeric material. For instance, the substrate may be seat pan, a polymeric sheet or a polymeric plate, that is relatively thin and extends over an area to at least partially define a portion of a seat assembly. As another example, the substrate may be a portion of a back frame assembly of a chair. As yet another example, the substrate 9 may be a portion of a seat frame that supports a seating surface or a portion of a back frame that supports a chair back surface.

The substrate 9 includes holes 13. Each hole 13 is sized and configured to receive a portion of a T-nut 11. The T-nut 11 includes a body 15 that defines a channel 17. Preferably, the body 15 has threads formed in the portion of the body 15 that defines the channel 17 such that a screw 21 or bolt may be screwed into or out of the channel 17.

The base 4 of the chair or another component of the chair may include a frame or frame portion that is sized and configured to attach to the covering 7 and substrate 9. The frame component 6 may be a portion of the chair base 4 or may be a portion of a seat frame assembly. In alternative embodiments, the frame component could be a portion of a back frame assembly. The frame component 6 may have holes sized and configured to receive a portion of the screws 21 that are inserted into the T-nuts to attach a seat component to the base 4 or the frame component 6.

As may be appreciated from FIGS. 6-10, each T-nut 31 may be inserted into the substrate to help attach the substrate to a chair component. Preferably, the T-nuts are standard T-nuts. The T-nut may be selected so that the size of the standard T-nut that is used meets design requirements of a chair. Of course, specialized or customized T-nuts could also be used, but such customized T-nuts would typically increase the cost for manufacturing a chair relative to the cost associated with using standard sized T-nuts.

Figure 6:
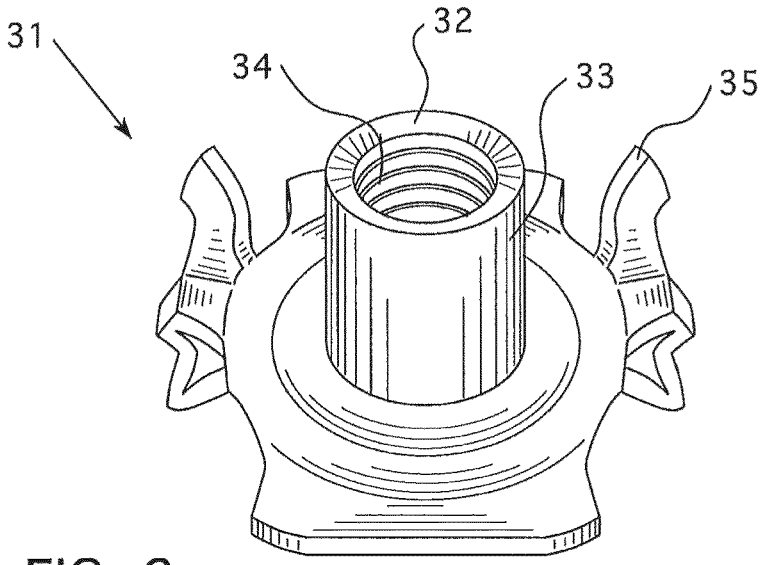
FIG. 6 is a perspective view of a present preferred T-nut that may be used in embodiments of our chair or in embodiments of our method of making such chairs.
Figure 7:
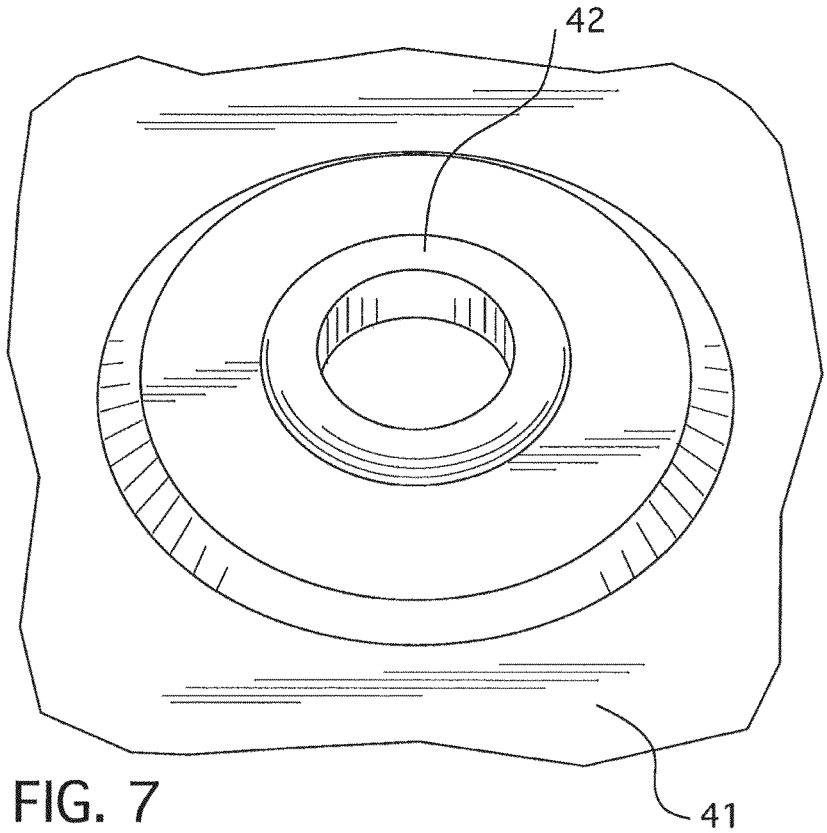
FIG. 7 is a fragmentary top view of a present preferred substrate composed of a polymeric material.
Figure 8:
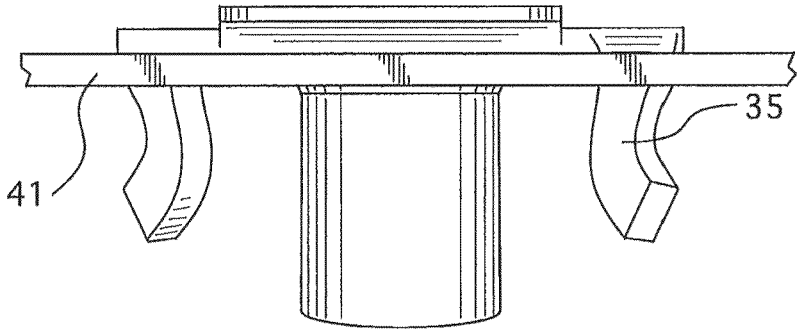
FIG. 8 is a side view illustrating the thickness of the present preferred substrate shown in FIG. 7 and the length of projections extending from a base portion of the present preferred T-nut shown in FIG. 6.
Figure 9:
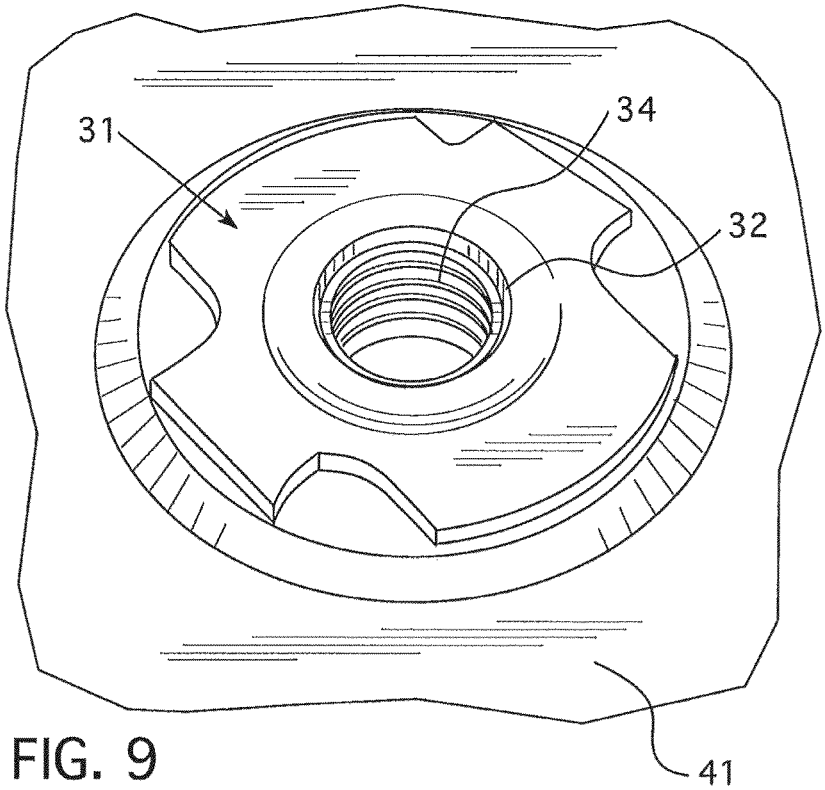
FIG. 9 is a fragmentary top view of the present preferred substrate shown in FIG. 7 having the present preferred T-nut of FIG. 6 inserted through the hole of the substrate and attached to the substrate.
Figure 10:
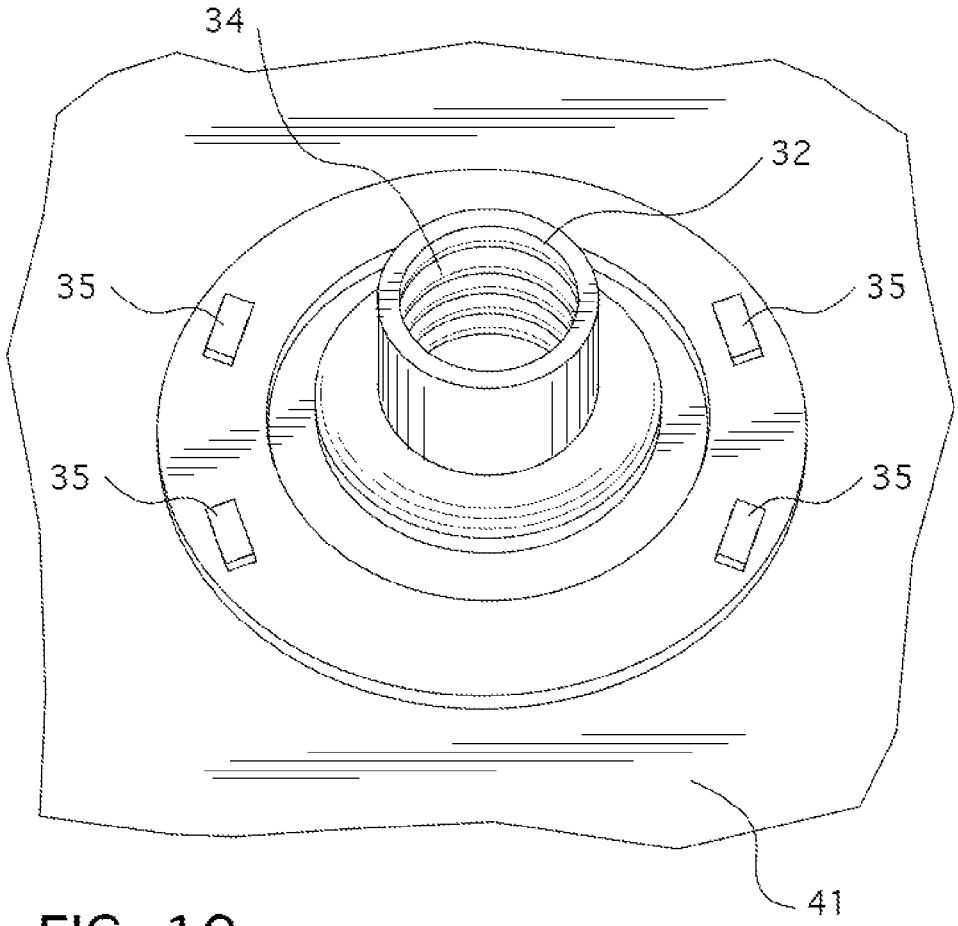
FIG. 10 is a fragmentary bottom view of the substrate and T-nut shown in FIG. 9 illustrating the projections of the T-nut after having been bent into the substrate. It should be appreciated that the bending of the distal ends of the T-nuts may be caused by hammering or pressing the distal ends of the T-nut.

As may be appreciated from FIG. 6, a standard T-nut 31 includes a body 33. A number of projections 35 extend from the body. Also, a portion of the body defines a channel 32 that has threads 34. The channel 32 may extend from a first open end of the body to a second open end of the body that is opposite the first open end of the body. The projections 35 of the T-nut preferably include a barb at the distal end of the projection. The barb is usually a slightly angled portion of the projection that helps the projection bite into or grip a component to which the T-nut is attached.

The portion of the body 33 that defines the channel 32 extends away from a base portion of the T-nut. The threads 34 are formed in the channel wall and are configured to receive a screw, bolt or other threaded fastener so that the fastener may be inserted in to the T-nut and attach the T-nut to another component.

As may be appreciated from FIGS. 7-10, a substrate 41 preferably composed of plastic or other polymeric material has holes 42 that are sized to receive a portion of the T-nut 31 or be aligned with the channel of the T-nut 31. The substrate 41 is of a thickness such that the projections 35 of the T-nut are longer than the substrate is thick, as may be appreciated from FIG. 8. For example, the substrate 41 may be 0.125 inches thick and the projections 35 of the T-nut may extend 0.1875 inches from a base portion of the T-nut such that the projections 35 are longer than the substrate is thick.

After the T-nut 31 is inserted through the holes 42 in the substrate 41, the projections 35 extend out of the substrate 41. Traditionally, such a configuration of a T-nut in a substrate would be unacceptable because the T-nut would not be sufficiently affixed to the substrate to receive a fastener for attaching the substrate to another component.

However, we have developed a fabrication method that permits sufficient attachment of the T-nut 31 to the substrate 41 such that a thin skin component, substrate 41, can be attached to a frame component of a chair, such as a component of a chair base. After the projections 35 of the T-nut are positioned through the substrate 41, the distal ends of the projections 35 are smashed or bent into the substrate 41 to bend the distal ends of the projections into the substrate, as may be seen in FIG. 10. The bent projections clamp onto the substrate and increase the grip the projections 35 have on the substrate 41.

After conducting testing, we determined that the bent projections 35 provide sufficient attachment strength for the T-nut to receive a bolt or screw and permit the bolt or screw to be screwed through the channel 32 of the T-nut for attaching a skin component to a frame component. For instance, the T-nut 31 does not dislodge from the substrate 41 during the screwing of the screw or bolt into the channel 32 of the T-nut. The bent projections keep the T-nut 31 affixed to the substrate 41 throughout the insertion and attachment of the screw into the T-nut. In fact, experimentation results have found that at least a torque of 75 inch pounds can be applied to screw a screw or bolt into 10-24 sized T-nuts inserted into a polypropylene substrate that is 0.125 inches thick without dislodging or loosening the T-nuts from the substrate. Other experimentation found that the T-nut in one embodiment of our invention can withstand an axial force of 140 pounds before becoming dislodged or loosened from a substrate that is 0.125 inches thick.

Figure 11:
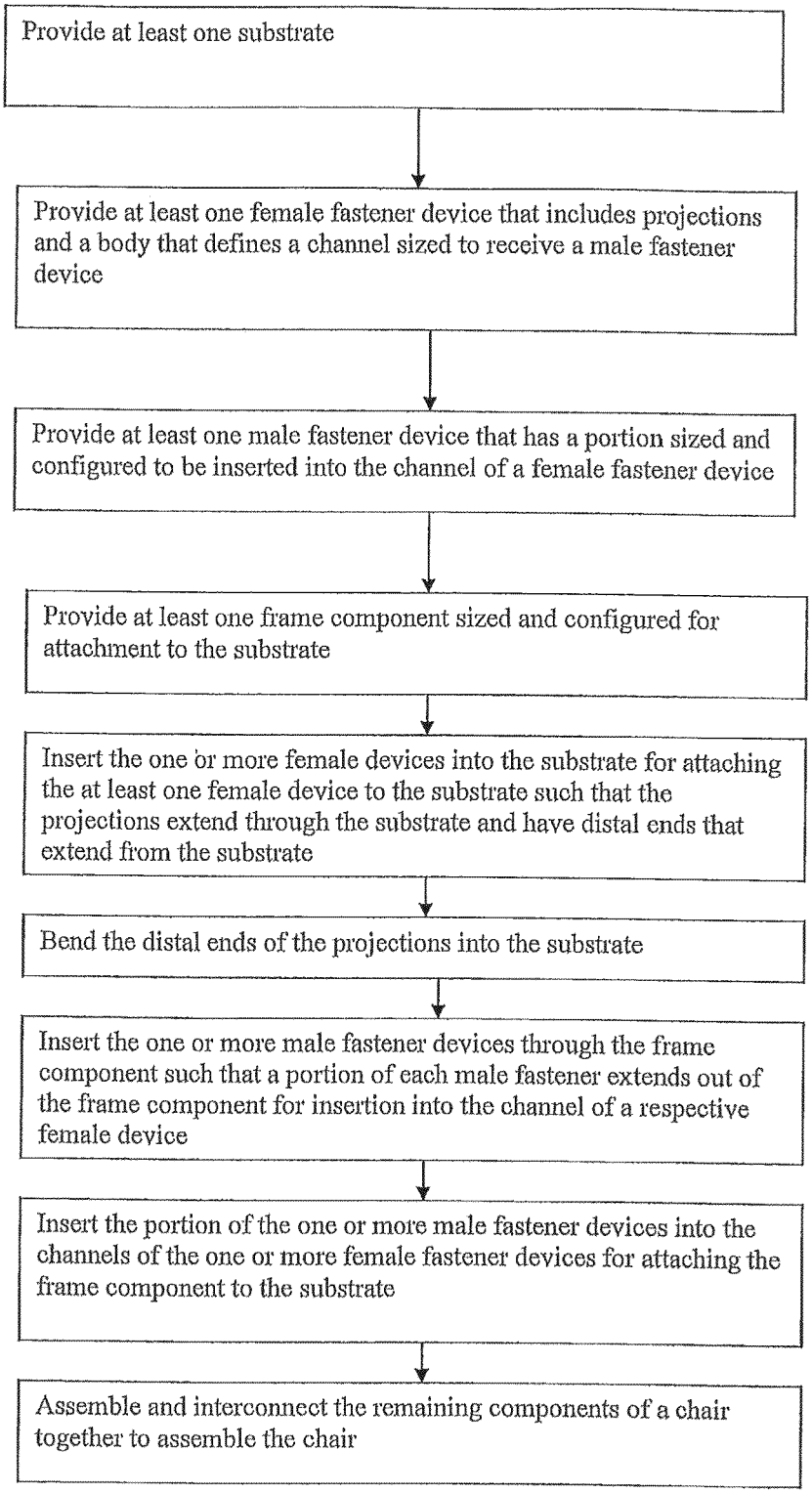
FIG. 11 is a flow chart illustrating a present preferred method of assembling chair components for chair fabrication or the fabrication of other furniture.

A present preferred embodiment of a method for assembling chair components is also provided, as may be appreciated from FIG. 11. Embodiments of the method can include providing a chair component that includes a substrate. The substrate may be a frame component of a chair back or seat that is configured for attachment to a foam cushion, padded covering, seat skin or back skin. The substrate may be configured to support or directly support the covering, seat skin or back skin to which it is attached. The substrate may also be configured to be the upper surface of the seat and directly engage a portion of a seated user's body to help support the seated user. The substrate may be composed of a polymeric material or metal. Preferably, the substrate is sonic welded, adhered, or otherwise attached to a seat skin or back skin component such as a foam pad or cushion.

At least one female fastening device is also provided. Each female fastener device may include a body that has a plurality of projections and a channel sized to receive a male fastener device. Each female fastener device may be a T-nut. The female fastening device is attached to the substrate such that the channel is aligned with a hole formed in the substrate. Preferably, multiple female fastening devices are provided and are attached to the substrate.

When attached to the substrate, the distal ends of the projections of each female fastening device extend from the substrate. The distal ends are then bent into the substrate. The bent distal ends clamp the substrate to tighten the grip the projections have on the substrate and strengthen the attachment the female fastener device has with the substrate. It should be appreciated that the distal ends of the projections may be bent by hammering, bending, pressing, or clamping the distal ends of the projections into the substrate. In some instances, the distal ends of the projections may be a barb, or may be barbed.

A frame component is also provided. The frame component has at least one opening. The frame component is preferably a portion of a back frame or a portion of a seat frame. The frame component may be composed of metal or a polymeric material.

At least one male fastening device is also provided that is sized and configured to be received within the channel of the female fastening device and also has a portion that is sized and configured to pass through the opening of the frame. Each male fastening device may be a screw or bolt.

The male fastening device is positioned such that a portion of the male fastening device extends through the hole of the frame and is inserted into the channel of the T-nut to attach the frame component to the substrate.

While certain present preferred embodiments of chairs and methods of making such chairs have been shown and described above, it is to be distinctly understood that the invention is not limited thereto but may be otherwise variously embodied and practiced within the scope of the following claims.

What is claimed is:

1. A chair comprising:

a base;

a frame attached to the base;

a substrate attached to the frame, the substrate having a first side and a second side opposite the first side;

at least one female fastener device, the at least one female fastener device comprising a body, and a plurality of projections attached to the body, a portion of the body defining a channel sized and configured to receive a male fastener device, each projection of the plurality of projections having a distal end;

the at least one female fastener device positioned in the substrate such that at least a portion of the body defining the channel extends from the first side of the substrate into the substrate and the projections extend through the substrate such that a portion of each of the projections extend into the first side of the substrate and a portion of the projections adjacent to the distal ends of the projections extend beyond the second side of the substrate and wherein the distal ends of the projections are bent into the second side of the substrate; and at least one male fastener device positioned in the channel of the at least one female fastener device to attach the frame to the substrate, each of the at least one male fastener device being inserted into the channel of a respective one of the at least one female fastener device.

2. The chair of claim 1 wherein the frame is a seat frame.

3. The chair of claim 1 wherein the frame is a back frame.

4. The chair of claim 1 wherein the at least one male fastener device is at least one screw or at least one bolt and the at least one female fastener is at least one T-nut.

5. The chair of claim 4 wherein the distal ends of the projections have barbs defined thereon.

6. The chair of claim 1 wherein the substrate is an upper surface of a seat and the frame is a seat frame.

7. The chair of claim 5 further comprising a cushion that is attached to the substrate.

8. The chair of claim 5 further comprising a seat skin attached to the substrate.

9. The chair of claim 1 wherein the frame is a back frame and the chair further comprises a back skin that is connected to the substrate.

10. The chair of claim 1 wherein the substrate is sized and configured to directly support a back skin, a seat skin, a seat covering or a back covering.

11. The chair of claim 1 wherein the frame is a portion of a seat frame assembly or a portion of a back frame assembly.

12. The chair of claim 1 wherein the substrate is comprised of a polymeric material and the at least one female fastener device is comprised of metal.

13. The chair of claim 1 wherein the distal ends are smashed into the second side of the substrate.

14. The chair of claim 1 wherein threads are formed in the body and at least partially define the channel, the threads sized and configured to engage at least a portion of the at least one male fastener device such that the at least one male fastener device is attachable within the channel.

15. The chair of claim 1 wherein the at least one male fastener device is comprised of a plurality of male fastener devices and the at least one female fastener device is comprised of a plurality of female fastener devices.

16. The chair of claim 1 wherein the first side of the substrate is a top side of the substrate and the second side of the substrate is a bottom side of the substrate.

17. The chair of claim 1 further comprising a covering that covers at least a portion of the substrate.

18. The chair of claim 1 wherein the at least one female fastener device is a unitary structure composed of metal and wherein the body has a first end and a second end, the channel of the body extending from the first end to the second end, the first and second end defining openings that communicate with the channel.

19. The chair of claim 1 wherein the substrate has at least one hole sized and configured to receive at least a portion of the body of the at least one female fastener device and wherein the at least one female fastener device is positioned into the substrate for attaching the at least one female fastener device to the substrate such that the body of each of the at least one female fastener device is inserted into a respective one of the at least one hole.

20. The chair of claim 1 wherein the distal ends of the projections are bent into the second side of the substrate to affix the at least one female fastener device to the substrate to improve a strength of attachment between the substrate and the at least one female fastener device.

* * * * *